United States Patent [19]

Van Ryswyk

[11] Patent Number: 4,485,544

[45] Date of Patent: Dec. 4, 1984

[54] METHOD OF MAKING ARTICLES COMPRISING TWO COMPONENTS HINGED ONE TO THE OTHER

[76] Inventor: Henricus J. Van Ryswyk, 34 View St., Annandale, 2038, New South Wales, Australia

[21] Appl. No.: 350,034

[22] Filed: Feb. 18, 1982

[30] Foreign Application Priority Data

Mar. 4, 1981 [AU] Australia ..... PE7843

[51] Int. Cl.[3] ..... B23P 11/00

[52] U.S. Cl. ..... 29/417; 16/386; 16/390; 16/DIG. 42; 29/11; 29/443; 29/509; 29/515

[58] Field of Search ..... 16/13, 15, 85, 227, 16/231, 233, 277, 286, 304, 308, 380, 386, 387, 389, 390, 391, DIG. 42; 29/11, 417, 434, 437, 438, 439, 564.6

[56] References Cited

U.S. PATENT DOCUMENTS

| | | | |
|---|---|---|---|
| 834,635 | 6/1906 | Olson | 16/277 X |
| 1,494,456 | 5/1924 | Williams | 29/437 |
| 1,584,040 | 5/1926 | Severn | 29/438 |
| 1,753,216 | 4/1930 | Pierce | 29/438 |
| 2,213,448 | 9/1940 | Morton | 29/438 |
| 2,233,351 | 2/1941 | Rowe | 29/437 |
| 3,447,198 | 6/1969 | Doerner | 16/390 |
| 4,283,811 | 8/1981 | George | 29/11 X |

FOREIGN PATENT DOCUMENTS

| | | | |
|---|---|---|---|
| 2154562 | 5/1973 | Fed. Rep. of Germany | 29/11 |
| 2448689 | 4/1976 | Fed. Rep. of Germany | 16/391 |
| 2916560 | 11/1980 | Fed. Rep. of Germany | 29/437 |

*Primary Examiner*—Charlie T. Moon
*Assistant Examiner*—Ronald S. Wallace
*Attorney, Agent, or Firm*—LeBlanc, Nolan, Shur & Nies

[57] ABSTRACT

The manufacture of two hingedly connected components of a toggle latch by simultaneously press-forming two strips of metal feeding into a multi-phased die wherein the last operation comprises the folding of lugs on a component about an end portion of the other component so that oppositely projecting bosses on that end portion becomes homed in openings in the respective lugs.

6 Claims, 5 Drawing Figures

METHOD OF MAKING ARTICLES COMPRISING TWO COMPONENTS HINGED ONE TO THE OTHER

BACKGROUND OF THE INVENTION

This invention relates to the manufacture of articles comprising two components which are hinged together. More particularly, it relates to such articles wherein the components have hitherto each been furnished with two, spaced-apart, substantially parallel lugs disposed so that the inwardly facing surfaces of the lugs of one component embrace and make substantial sliding contact with the outwardly facing surfaces of the lugs of the other component with a hinge pin extending through the four lugs.

Typical of such components are sheet metal pressings as used, for example, in toggle latches. Indeed, the invention was devised primarily with the manufacture of toggle latches in mind and is described hereinafter as related to that purpose, however it will be appreciated that it is applicable generally to all sheet metal components which require to be hinged together by means of co-acting pairs of lugs thereon.

A toggle latch of the kind in question comprises a mounting piece, a lever hinged upon the mounting piece and a pull link hinged upon the lever.

The mounting piece may comprise a body plate pierced by one or more holes to enable it to be secured flatly to a container wall or the like and two substantially parallel tabs or lugs projecting perpendicularly from the body plate at one end thereof.

The lever may comprise a channel-sectioned bar with projecting lugs at one end, being extensions of the channel flanges. Hitherto the body plate and the lever have been hinged together by means of a hinge pin extending through their lugs so that the lever may be swung from an unlatched position wherein the web of the channel is in the same plane as the body plate to a latched position wherein the body plate is embraced by the channel flanges.

The pull link may be a hook or a wire stirrup or yoke pivotally mounted on the lever to be moved substantially longitudinally of itself when the lever is swung from its unlatched position to its latched position. The link is adapted to engage a projection on a container lid or the like and the arrangement is such that when the lever is in said unlatched position the link is free to be engaged over or withdrawn from the projection and when the lever is swung to its latched position the link is drawn into firm engagement with the projection.

Usually the pivotal connection between the link and the lever is carried across the line of action connecting the point of contact of the link with the projection and the hinge axis of the lever with an "over-centre" or "toggle" action to keep the latch closed until the lever is manually swung into the unlatched position.

Thus prior known toggle latches have comprised four components namely the mounting piece, the lever, the hinge pin and the pull link. Furthermore, their manufacture has necessitated an assembly operation wherein the lugs on the mounting piece and lever are brought into alignment, the hinge pin is positioned through the clearance holes in the lugs and then its ends are rivetted over or otherwise conditioned to maintain it permanently in place.

SUMMARY OF THE INVENTION

In view of the foregoing an object of the present invention is to reduce the manufacturing cost of toggle latches by eliminating the hinge pin and the aforesaid assembly operation.

The invention consists in a method of making two components hinged together comprising the steps of forming two, parallel, spaced-apart co-directed lugs on one component, forming two, co-planar, oppositely directed lugs on the other component, forming clearance holes in two of said lugs, forming projections on the other two of said lugs, forming said co-planar, oppositely directed lugs into a U-shape and folding said co-directed lugs towards each other to embrace said U-shaped lugs and engaging said projections respectively into said clearance holes.

According to preferred embodiments of the invention the projections are so called punch-formed extrusions.

DETAILED DESCRIPTION OF PREFERRED EMBODIMENT

Figure 4:
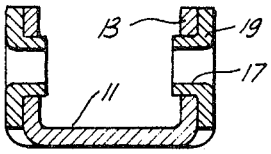
FIG. 4 is a cross-section along the line 4—4 in FIG. 3 drawn to a larger scale.
Figure 1:
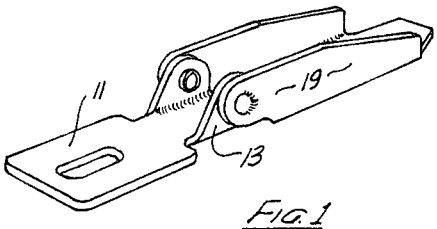
FIG. 1 is a perspective view of two components of a toggle latch made in accordance with this invention.
Figure 2:
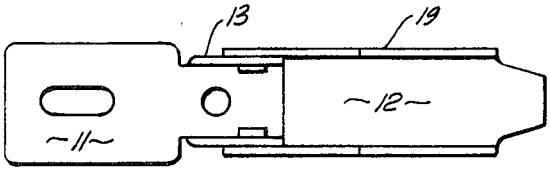
FIG. 2 is a plan view thereof.
Figure 3:
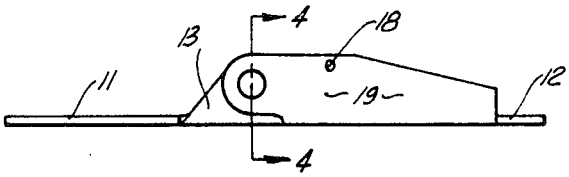
FIG. 3 is a side view thereof.
Figure 5:
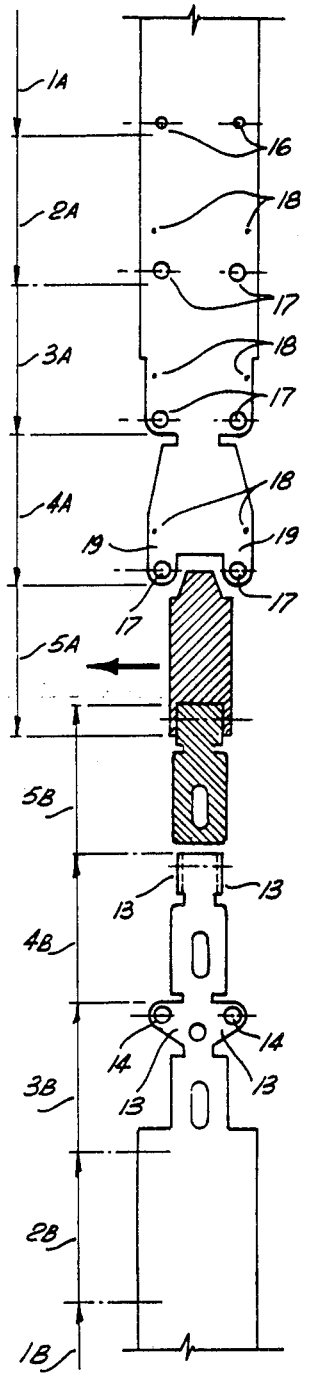
FIG. 5 is a plan view of two strips of workstock showing the effect of successive press-forming steps thereon during the manufacture of two components by a method according to the invention.

According to said embodiment the two components in question are the mounting piece 11 and lever 12 of a toggle latch. The components are press-formed simultaneously by a phased die from separate strips of workstock fed intermittently into opposite ends of the die simultaneously.

After each pressing operation each strip is advanced a distance equal to the length of the respective components and the final operation joins the two components together and simultaneously cuts them from their strips so that it is produced as a finished, that is to say hinged together, item, directly from the die.

The phases in respect of the first component 11, that is to say, mounting piece, comprise a first phase 1B and second phase 2B which serve only to move the strip in step with the second strip. In phase 3B the strip side edges are profiled to provide a body plate with two lugs 13 projecting in opposite directions in the plane of the plate and the lugs and body plate are pierced with clearance holes 14. In the fourth phase 4B the two lugs 13 are folded about parallel lines at their bases so that they then project perpendicularly as a U-shape from the body plate with their clearance holes in alignment.

In the first phase 1A in respect of the second component 12, namely the lever, the workstock is pierced with two small diameter punches to produce small diameter holes 16 in the strip at positions where ultimately projections will be formed. In the second phase 2A an extruding punch produces two small spigot type projections 17 from the material surrounding the small diameter holes produced in the first phase and at the same time the strip is pierced with further holes 18 for later accommodation of the ends of a wire pull-link in the form of a wire stirrup. The third phase 3A in respect of this component is to profile its side edges. The fourth phase 4A further profiles the side edges to finish forming the lugs 19.

The final phases 5A and 5B respectively for each component is to fold the edge lugs 19 of the second component 12 about parallel longitudinally extending lines to convert the component into a channel-sectioned piece and to bring its lugs 19 into close contact with the outer surfaces of the lugs 13 of the first component with the respective projections 17 then extending through the clearance holes 14 in the first component lugs. At the same time the two components are severed from the work strips to come away when the die is opened as a completed assembly.

It will be appreciated that in other embodiments the clearance holes and co-acting extrusions may be interchanged between the respective components.

I claim:

1. A method of making two components as a hinged assembly comprising the steps of feeding separate strips of work stock intermittently and simultaneously into opposite portions of a phased die and operating the phased die to simultaneously form both strips and thereby press-forming two, co-planar, oppositely directed lugs on one piece of work stock, press-forming two parallel spaced apart co-directed lugs on the other piece of work stock, press-forming a clearance hole in each of two of said four lugs, press-forming a protrusion on each of the other two of said four lugs, press-forming said co-planar, oppositely directed lugs into a U-shape, then press-folding said co-directed lugs towards each other to embrace said U-shaped lugs, said protrusions being disposed in a direction so that by said folding step said protrusions are engaged respectively into associated said clearance holes, and then press-severing each of the formed portions of the assembly from the work stock to produce two components hingedly connected together with the two clearance holes and two protrusions co-axial on the hinge axis.

2. A method as defined in claim 1 wherein the final operation hingedly connects and severs the two components from said separate strips.

3. A method as defined in claim 1 wherein the two components are the base plate and lever portion of a toggle latch respectively.

4. A method as defined in claim 1 wherein said protrusions are punch-formed extrusions.

5. A method of making two components hinged together as defined in claim 1, wherein: each component has a set of two lugs; in one set of two lugs, each lug has a said clearance hole formed therein; and in the other set of two lugs, each lug has a said protrusion formed thereon.

6. A method of making two components hinged together as defined in claim 1, wherein: for the two lugs on said one component, each lug has a said protrusion formed thereon; and for the two lugs on said other component, each lug has a said clearance hole formed therein.

* * * * *